United States Patent [19]

Hufgard

[11] Patent Number: 4,993,642

[45] **Date of Patent: * Feb. 19, 1991**

[54] PAINT SPRAY GUN

[75] Inventor: John W. Hufgard, Novelty, Ohio

[73] Assignee: AccuSpray, Inc., Cleveland, Ohio

[ * ] Notice: The portion of the term of this patent subsequent to Apr. 10, 2007 has been disclaimed.

[21] Appl. No.: 456,552

[22] Filed: Dec. 26, 1989

Related U.S. Application Data

[63] Continuation-in-part of Ser. No. 297,128, Jan. 17, 1989, Pat. No. 4,915,303, which is a continuation-in-part of Ser. No. 101,563, Sep. 28, 1987, Pat. No. 4,905,905.

[51] Int. Cl.[5] ..... B05B 1/28

[52] U.S. Cl. ..... 239/300; 239/290; 239/526

[58] Field of Search ..... 239/290, 296, 297, 299, 239/300, 301, 525, 526; 251/309, 321

[56] References Cited

U.S. PATENT DOCUMENTS

| | | | |
|---|---|---|---|
| 1,608,833 | 11/1926 | Bickenmaier | 239/297 |
| 1,906,975 | 5/1933 | Larson | 239/297 |
| 1,910,673 | 4/1933 | Bramsen . | |
| 2,107,732 | 2/1938 | Gustaffson et al. | 239/290 |
| 2,602,004 | 7/1952 | Faktor | 239/301 |
| 2,740,670 | 4/1956 | Harder | 239/297 |
| 2,786,716 | 3/1957 | Peeps | 239/301 |
| 3,037,709 | 6/1962 | Bok et al. . | |
| 3,314,646 | 4/1967 | Austin | 251/321 |
| 3,448,765 | 6/1969 | McKinney | 251/321 |
| 3,799,447 | 3/1974 | Beal | 239/526 |
| 4,176,793 | 12/1979 | Heinrich | 239/526 |
| 4,221,339 | 9/1980 | Yoshikawa | 239/704 |
| 4,286,734 | 9/1981 | Tonge | 239/526 |
| 4,334,637 | 6/1982 | Baker et al. | 239/600 |
| 4,531,675 | 7/1985 | Muck . | |
| 4,744,518 | 5/1988 | Toth | 239/297 |
| 4,776,517 | 10/1988 | Heren | 239/526 |
| 4,915,303 | 4/1990 | Hufgard | 239/300 |
| 4,917,300 | 4/1990 | Gloviak et al. | 239/290 |

FOREIGN PATENT DOCUMENTS

| | | | |
|---|---|---|---|
| 222966 | 7/1959 | Australia . | |
| 753510 | 8/1944 | Fed. Rep. of Germany | 251/309 |
| 2606008 | 8/1977 | Fed. Rep. of Germany | 239/300 |
| 348141 | 5/1931 | United Kingdom | 239/300 |
| 496231 | 11/1938 | United Kingdom | 239/553 |
| 736131 | 8/1955 | United Kingdom | 239/296 |
| 2115112 | 9/1983 | United Kingdom | 251/309 |

*Primary Examiner*—Andres Kashnikow
*Assistant Examiner*—Christopher G. Trainor
*Attorney, Agent, or Firm*—Sidney W. Millard

[57] ABSTRACT

An improved spray nozzle for use with air atomizable liquids wherein the spray pattern created by the atomizing nozzle may be adjusted from a circular pattern to a flat pattern or alternatively to an open oval, the open end facing in preselected directions, the adjustments being capable of occurring during the continuous operation of the nozzle. The body of the gun is formed of molded plastic parts bolted together. Fluid control components incorporated into cavities in the molded gun body are easily removable and replaceable to facilitate repair and cleaning of the gun.

16 Claims, 3 Drawing Sheets

FIG. 1
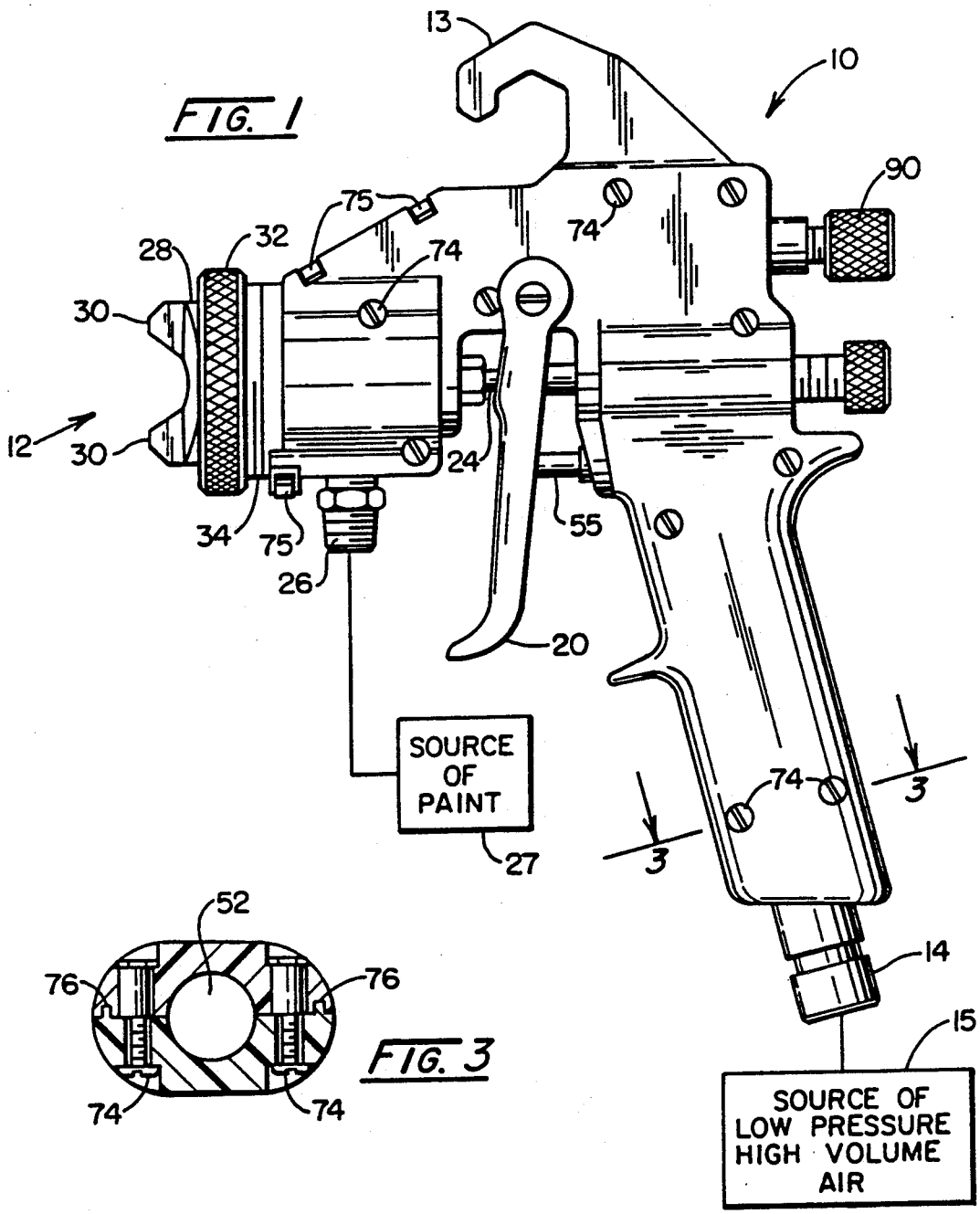
FIG. 3
FIG. 2
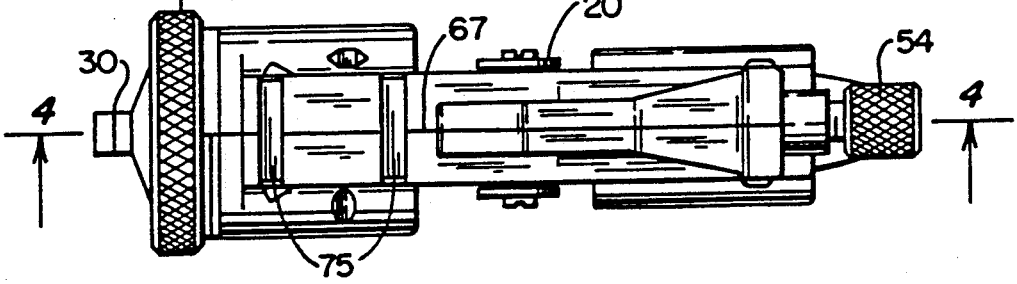

FIG. 4
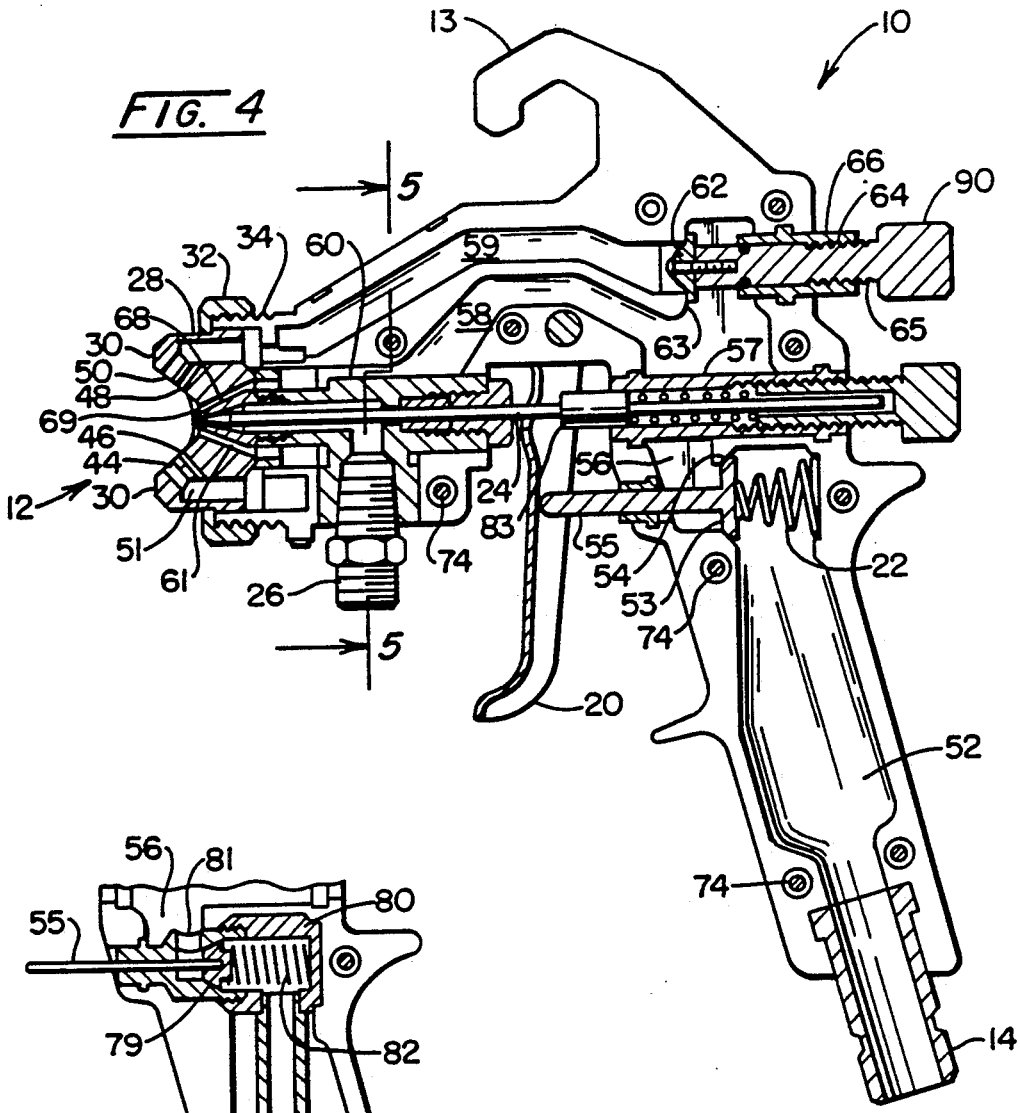
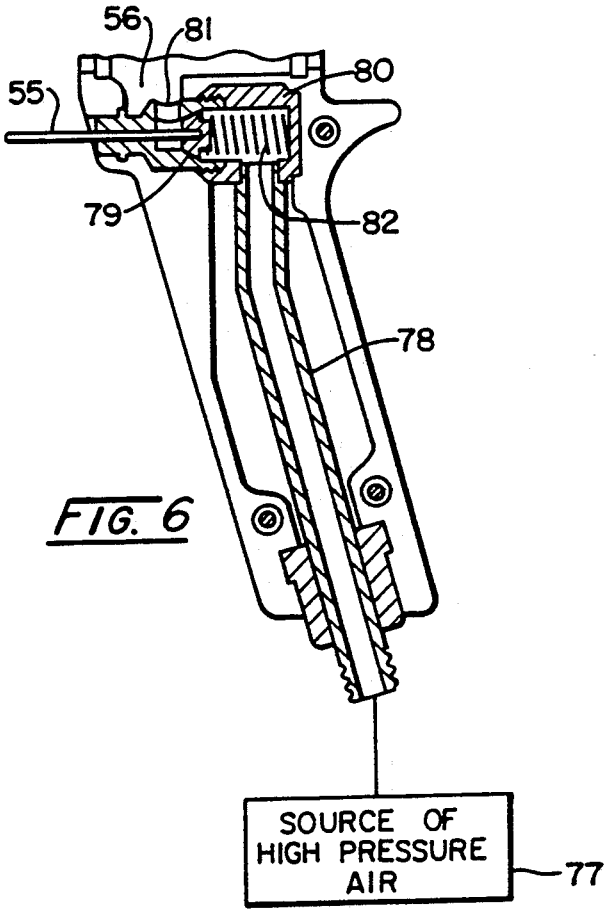
FIG. 6
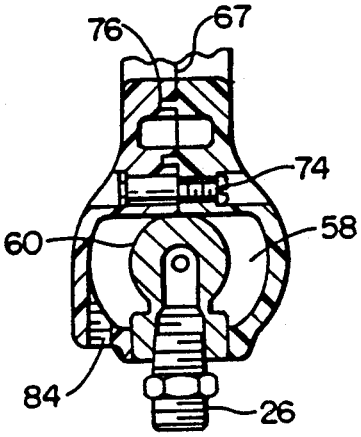
FIG. 5

PAINT SPRAY GUN

This is a continuation-in-part of application Ser. No. 297,128, filed Jan. 17, 1989, now U.S. Pat. No. 4,915,303 which is a continuation-in-part of application Ser. No. 101,563 filed Sept. 28, 1987, now U.S. Pat. No. 4,905,905.

FIELD OF THE INVENTION

The invention relates to an improved paint spray gun and nozzle for adjusting the spray pattern using low pressure and high volume air for atomizing the paint and controlling the spray pattern.

BACKGROUND OF THE INVENTION

Spray guns and nozzles, especially those used with spray painting systems, atomize the liquid paint by means of atomizing air which enters the nozzle area via a chamber which surrounds a liquid nozzle. The atomizing air exits the chamber via a central aperture located at the end of the chamber. The paint is atomized by the accelerating burst of forward motion of this air as it exits the nozzle via the aperture. The initial conventional pattern of the atomized liquid and air mixture in cross-section is a circle because the exit aperture is circular.

The term "pattern" as used herein describes a cross-section of the atomized cloud of paint droplets in a plane perpendicular to the direction of the spray from the fluid nozzle.

When the compressed air source for a spray painting apparatus utilizes a high volume, low pressure compressor, it is conventional for the air exit nozzle on the spray painting gun to have a central aperture which is considerably larger than the circumscribed liquid nozzle. Therefore, the large amount of air utilized in a conventional nozzle is due to the relative size of the central aperture compared to that of the liquid nozzle. This excess air, air beyond that required to atomize the liquid properly, constitutes an energy waste as well as a pollution problem. The excess air is a pollution problem since the air in a paint system will tend to carry the paint solvent. The more air that is used, the more dilute the solvent, and the more air that must be processed for the removal of solvents.

Therefore, there is a need for an improved spray nozzle which more efficiently utilizes the air that it actually receives from the air source.

The pattern of a spray nozzle is conventionally adjusted by impinging additional air jets on the original circular pattern at a location beyond the outlet aperture. A standard design may include two oppositely directed jets which produce a flat or oval pattern, and if those jets are very powerful they produce a flat fan-shaped spray pattern which is many times wider than it is high. However, in other applications, there are needs for other than such flat or oval patterns, especially when spray painting the reverse sides of objects or spray painting in an out-of-position way and also the traditional problem of painting the inside of angular surfaces.

Another problem with spray guns is that the air from a high volume, low pressure compressor is hot and tends to heat metal parts in the flow path to an extent that hand held spray guns may burn the operator or at least make his hand most uncomfortable.

SUMMARY OF THE INVENTION

An improved spray gun according to this invention includes an atomizing chamber with a central aperture for the exit of atomized liquid spray. The chamber has a converging frusto-conical surface approaching the aperture that acts to direct and streamline the atomizing air.

A liquid nozzle is mounted concentrically with the aperture and the exterior surface is structured to further direct atomizing air through the aperture in streamline flow as opposed to turbulent flow.

Another aspect of the present invention is a pattern adjusting plug valve which adjusts air flow to the pattern adjusting nozzles which may be directed at the atomized liquid spray.

The shell of the gun is molded from a resin in two mirror image halves which are bolted together. The resin will serve as an insulator because it is a poor heat conductor. Valves, nozzles, flow adjustment apparatus, etc. incorporated into the two molded halves are mostly metallic components which fit into molded cavities. Thus, metallic parts may be easily removed or replaced and the molded shell is easily cleaned during maintenance or repair periods.

Objects of the invention which are not obvious from the above will be clear from a review of the drawing and the description of the preferred embodiments which follow.

BRIEF DESCRIPTION OF THE DRAWINGS

The best mode contemplated in carrying out this invention is illustrated in the accompanying drawings in which:

FIG. 1 is an elevational view of a paint spray assembly utilizing a nozzle according to the present invention;

FIG. 2 is a top plan view of the gun of FIG. 1;

FIG. 3 is a cross-sectional view taken along line 3—3 of the gun of FIG. 1;

FIG. 4 is a cross-sectional view taken along line 4—4 of the gun of FIG. 2;

FIG. 5 is a cross-sectional view taken along line 5—5 of the gun of FIG. 4;

FIG. 6 is a fragmental sectional view of the internal structure of the handle of a first alternative form of gun supplied by a source of high pressure air;

DESCRIPTION OF THE PREFERRED EMBODIMENTS

Figure 7:
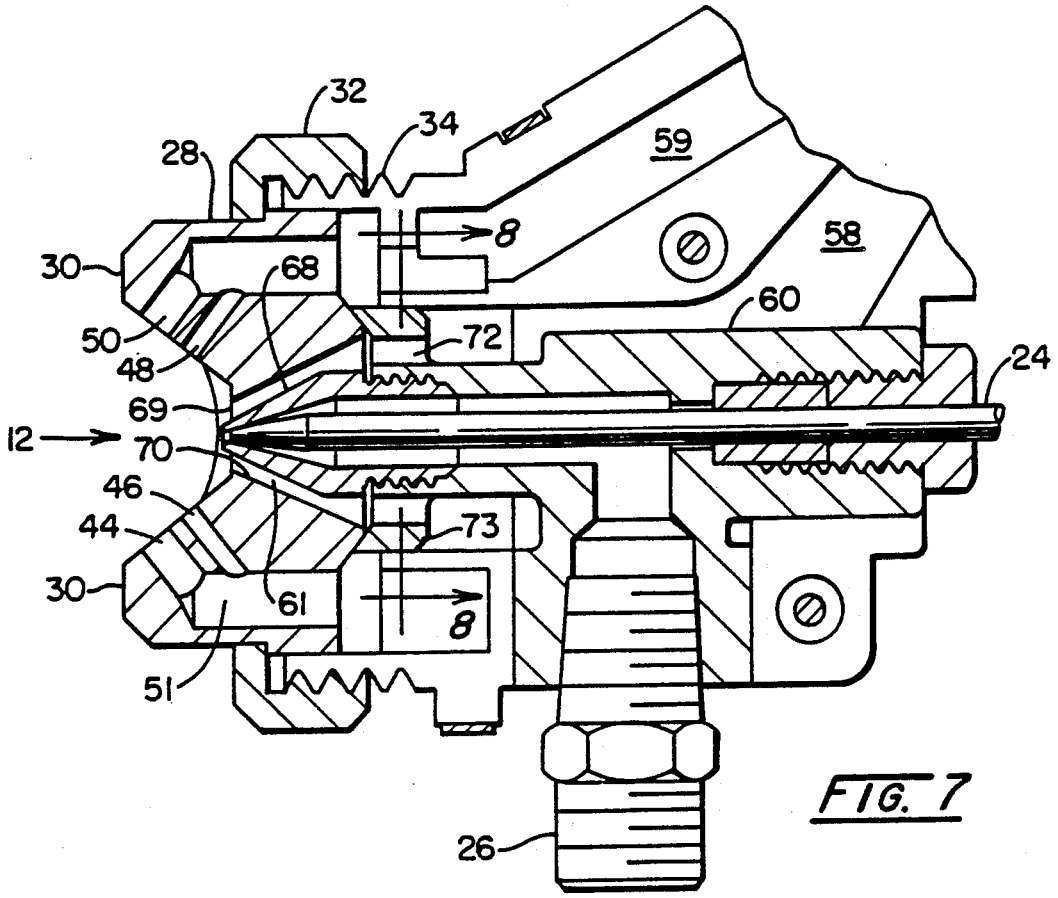
FIG. 7 is an enlarged sectional view of the nozzle area of the gun of FIG. 4.
Figure 8:
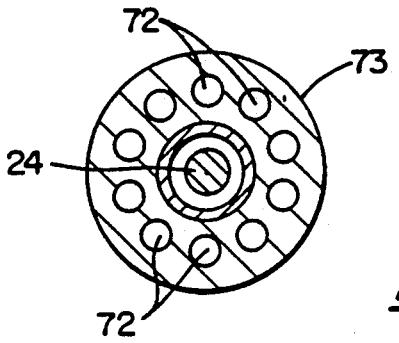
FIG. 8 is a sectional view taken along line 8—8 of FIG. 7.

With reference to the drawings, FIG. 1 shows a paint spray gun 10 which utilizes a nozzle 12 according to the present invention. Any conventional spray painting gun has a pistol grip type handle on the body 10 and can optionally have a hook assembly 13 for hanging the gun after work has been completed or for temporary storage.

An air supply fitting 14 provides a connection to a source 15 of low pressure, constant high volume compressed air to the spray painting assembly. Within the body of the spray gun 10 the air supply is directed along a path to an air chamber adjacent a paint nozzle as will be explained subsequently.

The body of the paint gun 10 also has a trigger assembly 20 which is held in its closed position by a spring 22

(best seen in FIG. 4) in the base of the handle. Additionally a pull rod 24 is moved by the trigger assembly, pull rod 24 serving to adjust the flow rate of paint to the nozzle tip while paint supply fitting 26 provides direct access to the supply of paint 27.

On the forward end of the gun 10 is a nozzle or air cap 28 having a pair of forwardly projecting ears 30, best seen in FIG. 4. The cap 28 is mounted in operative position on gun 10 and secured in place by a collar 32 threadedly engaging external threads 34 on the gun.

Turning now to FIGS. 4 and 7, within the concave nozzle ear faces are pattern adjusting orifices 44, 46, 48, 50 in fluid communication with an air passage 51. Air supply fitting 14 admits air into the handle of the gun, the handle forms flow path 52. A piston 53 on one end of a rod 55 is mounted in the path 52. Spring 22 biases piston 53 against annular sealing seat 54 to close path 52. A depression of trigger 20 moves rod 55 and piston 53 to the right as seen in FIG. 4 to compress spring 22 and open flow path 52 for the passage of air into flow path 56. Air in flow path 56 will flow annularly around cylinder 57 to two bifurcated flow paths 58 and 59. Air in flow path 58 flows around the paint supply housing 60 as best seen in FIG. 5 on its way to air chamber 61. The second flow path 59 leading to the nozzle area may be blocked by a rotable valve having a face 62 abutable with a sealing seat 63. Adjustment of the valve face 62 is by a knob 90. Rotation of knob 90 may retract valve face 62 from seat 63 as the threaded connection 64 of stem 65 with ferrule 66 allows adjustment of air to orifices 44, 46, 48 and 50. The valve may be adjusted from fully open to fully closed and anyplace in between.

FIG. 2 is a top plan view of the gun of FIG. 1. Line 67 is the split between the two halves forming the body of gun 10.

The body of the gun itself is formed of two molded pieces which are mirror images of each other. The pieces are formed from fiber glass filled nylon (about 30% fiber glass by volume) or Ryton brand resin, polyphenylene sulfide, in the preferred embodiment but other suitable resins may be used. Any appropriate resin should be a low conductor of heat to protect the hand of an operator from heat in the compressed air from the compressor or turbine (up to 180° F.). Additionally, the resin should be easy to mold into the illustrated shape and solvent proof to prevent deterioration from paint solvents or airborne solvents in the atomized air.

A fragmentary cross-section of the spray nozzle assembly is shown in FIG. 7. In this view atomizing air chamber 61 is shown with liquid nozzle 68 penetrating it, atomizing air chamber 61 having a central aperture 69 located at its outlet end. It will be noted that the central aperture 69 has an upstream converging frusto-conical shaped surface 70. Preferably the frusto-conical shaped surface 70 has a slope of about 43°–54° and not corresponding to the converging conical end of liquid nozzle 68. That is, the angle subtended by the cone shaped surface 68 preferably is less than the angle formed by surface 70. Preferably the angle subtended by the cone shape surface 70 is about 40°–52°. The reason for the angle of surface 68 to be smaller than the angle of surface 70 is to have better control of the flow pattern.

Flow through path 58 leads through openings 72 in a radial flange 73 around nozzle 68, upstream of chamber 61. Flow into chamber 61 dampens flow turbulence to insure laminar flow of air through aperture 69. Laminar flow is desirable because it maintains a more uniform spray pattern at greater distances from aperture 69. The dampening takes place in chamber 61 because of the relatively narrow ports 72 allow the air to expand into the larger cross-sectional area of the chamber 61.

Note should be taken of the relatively large flow paths 58 and 59 (about 0.25 in.×0.5 in. oval cross-section for each) and the relatively gently curving path. This is necessary because of the desirability for high volume (about 5–60 cfm) and relatively low pressure (less than about 10 psig). Conventional compressor pressures are in the range 30–80 psig.

It is because of the low pressure utilized and the design of the interior of the gun that the gun may be formed of two molded resin halves held together by a plurality of screw combinations 74, best illustrated in FIG. 3, and spring clips 75. With conventional air pressures the gun would leak like a sieve because it would bulge outwardly. Note the mating tongue-in-groove structure 76 in FIG. 3 to help minimize leaks. Alternatively grooves may be formed in each part to receive an O-ring seal.

An alternative embodiment of the gun is illustrated in FIG. 6. The difference is that the gun 10 is supplied from a convention source of high pressure air 77. Source 77 may supply air at a pressure in the range 30–120 psig and 30–60 standard cfm and the internal structure will deliver the same 30–60 standard cfm at less than 10 psig to flow path 56.

Metal tube 78 receives the high pressure air from source 77 and conducts it to valve 79. Valve body 80 is also of metal and the size of the outlet 81 into flow path 56 is such that air cannot exceed a pressure above about 10 psi. Outlet 81 is circular in cross-section and is about 0.187 inches in diameter. Metal tubes and valves are necessary at this point to insure that the air pressure will not burst the resin gun body.

In operation the operator will depress trigger 20 and apply pressure against rod 55. Trigger 20 opens the only source of air to passages 58 and 59. With adequate pressure to compress spring 22 (FIG. 4) or 82 (FIG. 6) air will flow through passages 56, 58 and 59 (if valve 62 is open). Air will begin to flow through circular opening 69 and orifices 44–50 before the paint nozzle is opened because the trigger will not engage axially adjustable shoulder 83 on pull rod 24 until after valve face 53 has receded from sealing face 54. This feature will insure that air flow starts before the paint valve opens and air flow will continue until after the paint valve is closed. Without this time delay feature there may be blobs of paint at the beginning or end of the paint operation.

Looking to FIG. 5, a threaded opening 84 is in fluid communication with air flow path 58 and it is usable when the source of paint is without its own pressure supply. If needed a fitting is threaded into opening 84 and a tube will be connected to said fitting and to the paint supply. Thereby, air from path 58 will flow through opening 84 and the tube into the paint container and provide the power to deliver the paint to the paint nozzle. When such air is not needed opening 84 is plugged.

Observing the hatching of the FIGS. 4–7 it will be noted that there are metallic parts which drop into cavities formed by the two molded halves of the gun. The two halves are mirror images of each other and the drop-in metallic parts are formed symmetrical. This drop-in feature allows easy removal and replacement of the metallic parts when the halves of the gun are disassembled for periodic cleaning and maintenance. Because the metallic parts are easily removed and replaced the cleaning of the gun halves is greatly facilitated, thereby providing a great savings in labor as compared to conventional guns where the air passages are drilled into a metallic piece. Additionally, should any one of the fluid control components fail during operation it can be replaced by an identical component and the gun quickly returned to operation with a minimum of equipment down time.

Having thus described this invention in its preferred embodiment, it will be clear that modifications may be made to the structure without departing from the spirit of the invention. For example, the gun is formed of two plastic parts; it could be of three, four or more parts if desired. Accordingly, it is not intended that the language of the specification nor the drawings illustrating the same be limiting on the invention. It is intended that the invention be limited only by the scope of the appended claims.

I claim:

1. A spray gun for use with air atomizable liquids comprising;

means forming an air chamber in said gun having an outlet end;

a liquid nozzle valve having a conical taper penetrating said air chamber and extending to and coaxially aligned with a central circular aperture in the outlet end of said air chamber;

means for delivering a liquid to said central aperture for atomization by air exiting said air chamber through said central aperture;

at least two pattern adjusting nozzles disposed adjacent to the central aperture of said air chamber;

means for conducting air to said chamber and separate means for conducting air to said nozzles;

trigger means for activating means to allow the flow of air to said nozzles and for activating means to allow the flow of liquid to said nozzle valve, the outlet end of said air chamber having a converging down stream frusto-conical shape which terminates at said central aperture, and said gun being formed as parts bolted together, said parts having internal passages extending from the nozzles to the means to allow flow of air to said nozzles, said passages of each of said parts being mirror images of said passages of the other part, said means to allow the flow of air to said nozzles being the only source of air to said passages.

2. The gun according to claim 1 wherein each pattern adjusting nozzle is located in a nozzle ear which projects beyond the plane of said central aperture.

3. The gun according to claim 2 including means for adjusting the flow of air to said pattern adjusting nozzles, said adjusting means includes a rotable valve in said separate air conducting means.

4. The gun according to claim 3 wherein said two pattern adjusting nozzles are located at diagonally opposite sides of said central aperture.

5. The gun according to claim 1 including means for adjusting the flow of air to said pattern adjusting nozzles, said adjusting means includes a rotable valve in said separate air conducting means.

6. The gun according to claim 1 including means for adjusting the flow rate of air to the pattern adjusting nozzles comprising a rotable valve in said air conducting means leading to said nozzles and configured to selectively open, close and partially open said air conducting means to receive air from said source.

7. The gun according to claim wherein said two pattern adjusting nozzles are located on diagonally opposite sides of said central aperture.

8. The gun according to claim 7 including means for adjusting the flow rate of air to the pattern adjusting nozzles comprising a rotable valve in said air conducting means leading to said nozzles and configured to selectively open, close and partially open said air conducting means to receive air from said source.

9. The gun according to claim 2 including means for adjusting the flow rate of air to the pattern adjusting nozzles comprising a rotable valve in said air conducting means leading to said nozzles and configured to selectively open, close and partially open said air conducting means to receive air from said source.

10. The gun of claim 1 wherein said parts are formed from thermoplastic resin.

11. The gun of claim 10 wherein said resin has the physical characteristics of:

(a) low heat conducting as compared to metals, (b) easy moldability, and (c) low solubility to paint solvents.

12. The gun of claim 11 wherein the resin is polyphenylene sulfide.

13. The gun of claim 12 wherein said passages are generally oval-shaped with dimensions of about $\frac{1}{4}$ in. $\times \frac{1}{2}$ in.

14. The gun of claim 13 wherein the source of air delivered to said passages is at a pressure in the range not substantially greater than about 10 psig. and a volume of about 5–60 cfm.

15. The gun of claim 1 wherein said gun parts are molded of fiber glass filled nylon, said fiber glass being about thirty percent by volume.

16. The gun of claim 1 wherein said parts are molded with cavities to receive metallic components, said components including the nozzles, trigger, valves, and inlets from paint and air sources; said components being easily removable and replaceable to facilitate cleaning the gun during maintenance and repair.

* * * * *

UNITED STATES PATENT AND TRADEMARK OFFICE

CERTIFICATE OF CORRECTION

PATENT NO. : 4,993,642

DATED : February 19, 1991

INVENTOR(S) : John W. Hufgard

It is certified that error appears in the above-identified patent and that said Letters Patent is hereby corrected as shown below:

In claim 7, column 6, line 16 after "claim" insert --1--.

Signed and Sealed this

Twenty-first Day of July, 1992

*Attest:*

DOUGLAS B. COMER

*Attesting Officer*

*Acting Commissioner of Patents and Trademarks*